US007407402B2

(12) United States Patent
Peng et al.

(10) Patent No.: US 7,407,402 B2
(45) Date of Patent: Aug. 5, 2008

(54) DETACHING APPARATUS FOR CONNECTOR

(75) Inventors: Wen-Tang Peng, Taipei Hsien (TW); Mo-Ming Yu, Shenzhen (CN); Jian Fu, Shenzhen (CN)

(73) Assignees: Hong Fu Jin Precision Industry (ShenZhen) Co., Ltd., Shenzhen, Guandong Province (CN); Hon Hai Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 11/739,699

(22) Filed: Apr. 25, 2007

(65) Prior Publication Data

US 2008/0057772 A1 Mar. 6, 2008

(30) Foreign Application Priority Data

Aug. 30, 2006 (CN) ..... 2006 2 0014409

(51) Int. Cl.
*H01R 13/627* (2006.01)

(52) U.S. Cl. ..... 439/352

(58) Field of Classification Search ..... 439/350–358
See application file for complete search history.

(56) References Cited

U.S. PATENT DOCUMENTS

| | | | | |
|---|---|---|---|---|
| 5,316,495 | A * | 5/1994 | Frantz | 439/372 |
| 6,530,802 | B2 * | 3/2003 | Letourneau | 439/372 |
| 6,702,475 | B1 * | 3/2004 | Giobbio et al. | 385/53 |
| 7,083,459 | B1 * | 8/2006 | Wu et al. | 439/354 |
| 7,300,300 | B2 * | 11/2007 | Meijer et al. | 439/372 |
| 2005/0075001 | A1 * | 4/2005 | Shearman et al. | 439/352 |

* cited by examiner

*Primary Examiner*—James Harvey
(74) *Attorney, Agent, or Firm*—Frank R. Niranjan

(57) ABSTRACT

A detaching apparatus is provided for detaching a connector having an elastic release tab from a mating connector socket of an electronic device. The release tab of the connector is engagable with the connector socket. The detaching apparatus includes a pivot member pivotably attached to the electronic device, and an operating member connectable with the pivot member. The operating member is manipulably rotatable together with the pivot member for pressing the release tab to disengage the connector from the connector socket of the electronic device.

18 Claims, 4 Drawing Sheets

DETACHING APPARATUS FOR CONNECTOR

BACKGROUND OF THE INVENTION

1. Field of the Invention

The present invention relates to detaching apparatuses, and more particularly to a detaching apparatus for a connector.

2. Description of Related Art

With the development of electronic technology, a greater number of small-sized connectors are being used in electronic devices. However, detaching a connector from a mating connector of an electronic device by hand can be difficult and inconvenient because of limited or cramped operating space, and the connector or a wire connected with the connector is easily loosened or broken when drawing the connector out from the electronic device.

What is needed, therefore, is a detaching apparatus which can be operated to safely and easily detach a connector from a mating connector of an electronic device.

SUMMARY OF THE INVENTION

A detaching apparatus is provided for detaching a connector having an elastic release tab from a mating connector socket of an electronic device. The release tab of the connector is engagable with the connector socket. The detaching apparatus includes a pivot member pivotably attached to the electronic device, and an operating member connectable with the pivot member. The operating member can be manipulated to rotate together with the pivot member for pressing the release tab to disengage the connector from the connector socket of the electronic device.

Other advantages and novel features will become more apparent from the following detailed description of preferred embodiments when taken in conjunction with the accompanying drawings, in which:

DETAILED DESCRIPTION OF THE INVENTION

Figure 1:
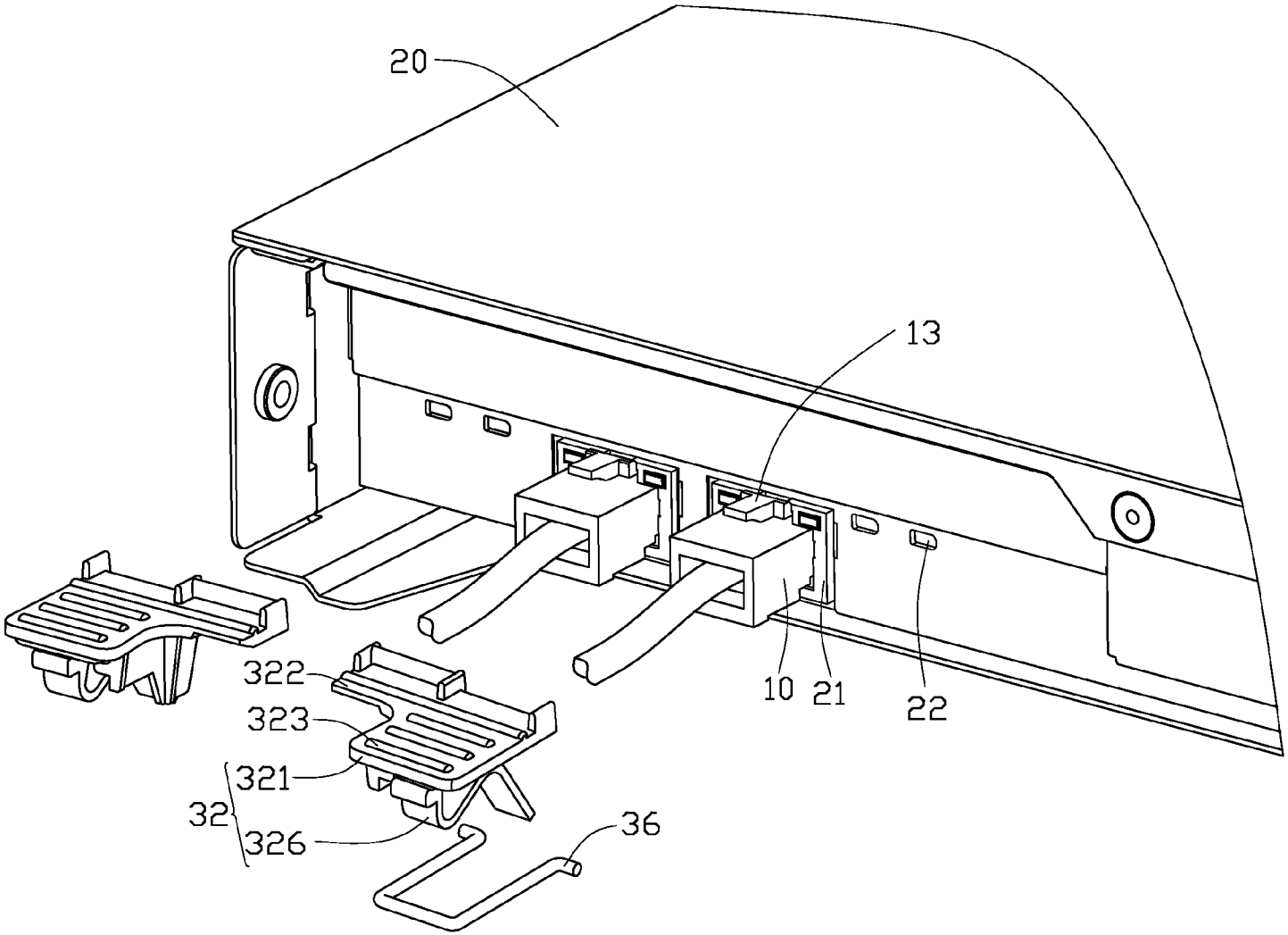
FIG. 1 is an exploded, isometric view of a detaching apparatus together with an electronic device and a connector in accordance with a first embodiment of the present invention.

Referring to FIG. 1, a detaching apparatus is provided in accordance with a first embodiment of the present invention, for detaching a connector 10 from a connector socket 21 of an electronic device 20. The detaching apparatus includes an operating member 32 and a pivot member 36. The electronic device 20 defines a pair of through holes 22 adjacent to the connector socket 21. The connector 10 forms an elastic release tab 13 thereon. When the connector 10 is inserted into the connector socket 21, the release tab 13 engages in the connector socket 21, with a free end of the release tab 13 remaining exposed.

Figure 2:
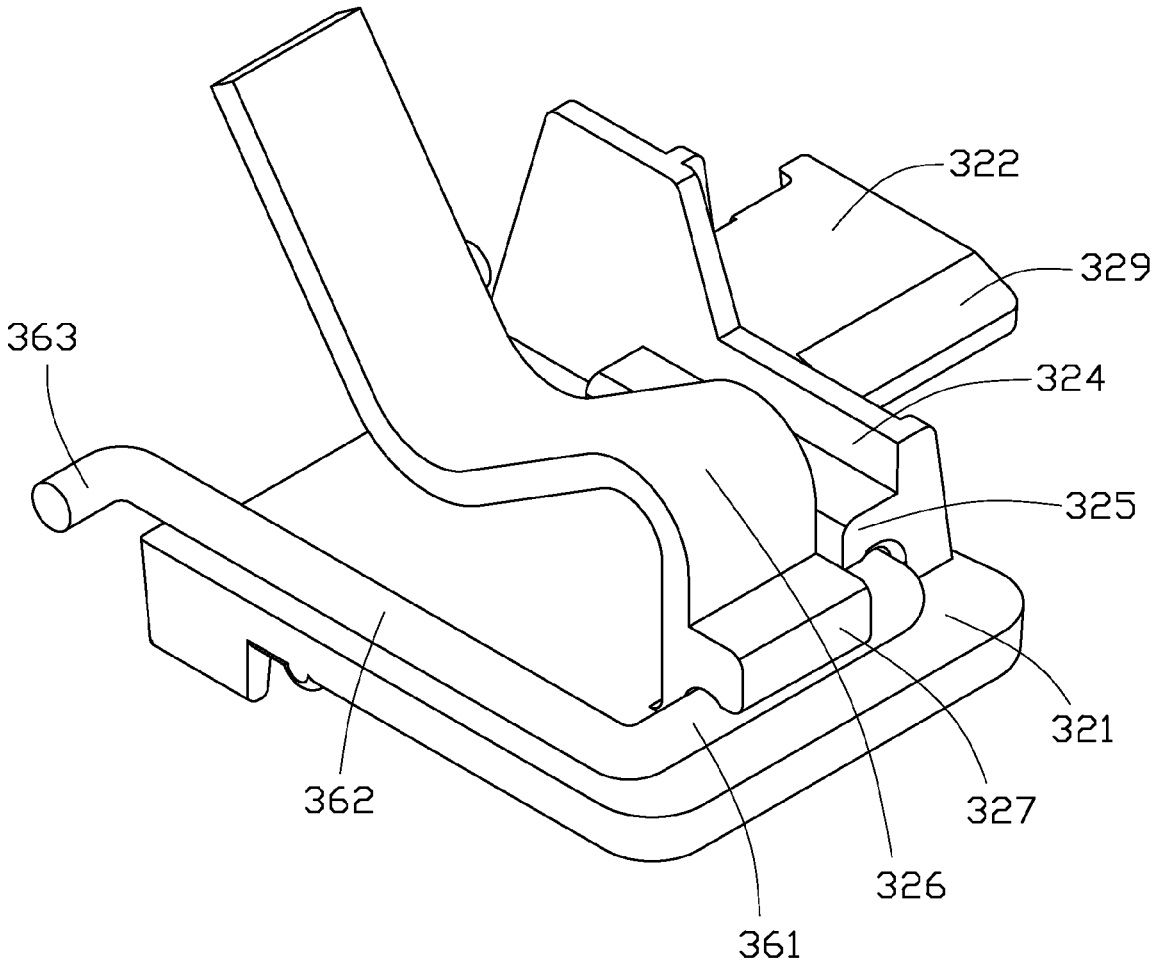
FIG. 2 is an enlarged isometric view of the detaching apparatus of FIG. 1, but viewed from another aspect.

Referring to FIGS. 1 and 2, the operating member 32 includes a main body 321, and a generally N-shaped elastic arm 326 extending from a bottom portion of the main body 321. A pressing portion 322 extends from an edge of the main body 321, a slanted surface 329 is formed on a bottom portion of the pressing portion 322, corresponding to the release tab 13 of the connector 10. A plurality of ribs 323 is formed on a top portion of the main body 321. A fixing plate 324 extends perpendicularly from the bottom portion of the main body 321 adjacent to the elastic arm 326, and the fixing plate 324 perpendicularly forms an arcuate cantilevered flange 325 adjacent to the main body 321 toward the elastic arm 326. An end of the elastic arm 326 is connected to the bottom portion of the main body 321, and a fixing portion 327 is perpendicularly formed on the end of the elastic arm 326 adjacent to the main body 321.

The pivot member 36 is generally U-shaped. The pivot member 36 includes a cross member 361 and two elastic legs 362 extending from opposite ends of the cross member 361 in parallel. An engaging portion 363 perpendicularly extends outward from a free end of each of the elastic legs 362.

Figure 3:
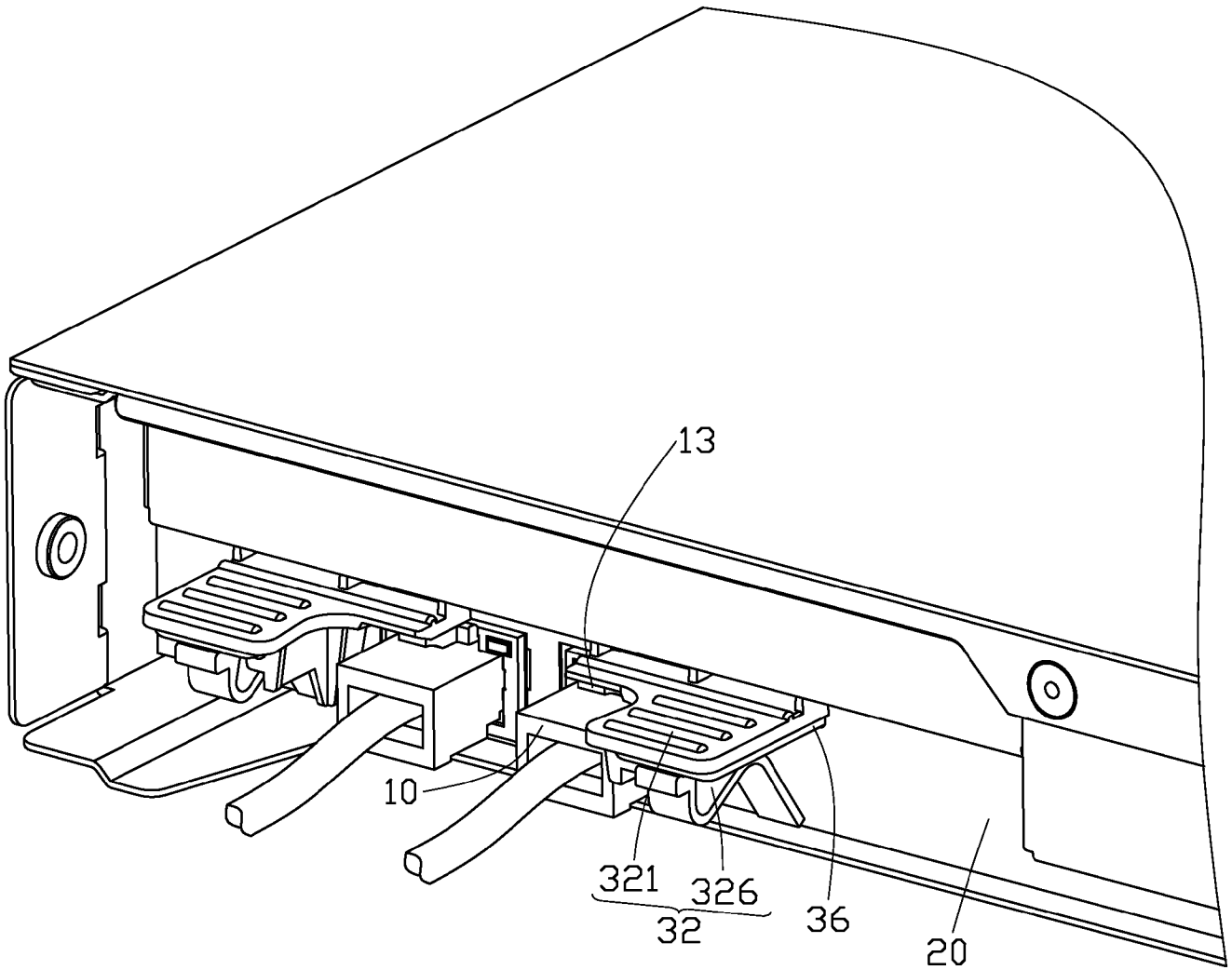
FIG. 3 is an assembled view of FIG. 1.

Referring to FIGS. 2 and 3, in assembly, the pivot member 36 is fixed to the operating member 32, with one elastic leg 362 of the pivot member 36 received and fixed between the flange 325 of the fixing plate 324 and the main body 321, the cross member 361 of the pivot member 36 received and fixed between the fixing portion 327 of the elastic arm 326 and the main body 321. The elastic legs 362 of the pivot member 36 are pressed toward each other and deform to allow engaging portions 363 to pass through the through holes 22 of the electronic device 20 respectively. After that, the elastic legs 362 are released and restore to make the engaging portions 363 engage with portions of the electronic device 20 bounding the through holes 22 respectively, thereby the detaching apparatus is pivotably fixed to the electronic device 20. A free end of the elastic arm 326 abuts against an L-shaped wall of the electronic device 20. The slanted surface 329 of the bottom portion of the pressing portion 322 abuts against a top surface of the free end of the release tab 13 of the connector 10.

When there is a need to detach the connector 10 from the electronic device 20, the main body 321 of the operating member 32 is pressed down, deforming the elastic arm 326, and the pivot member 36 is rotated down together with the operating member 32. The slanted surface 329 of the pressing portion 322 presses the exposed portion of the release tab 13 of the connector 10 downward, deforming the release tab 13 to disengage from the connector socket 21 of the electronic device 20, thereby releasing the connector 10 for easy detachment.

Figure 4:
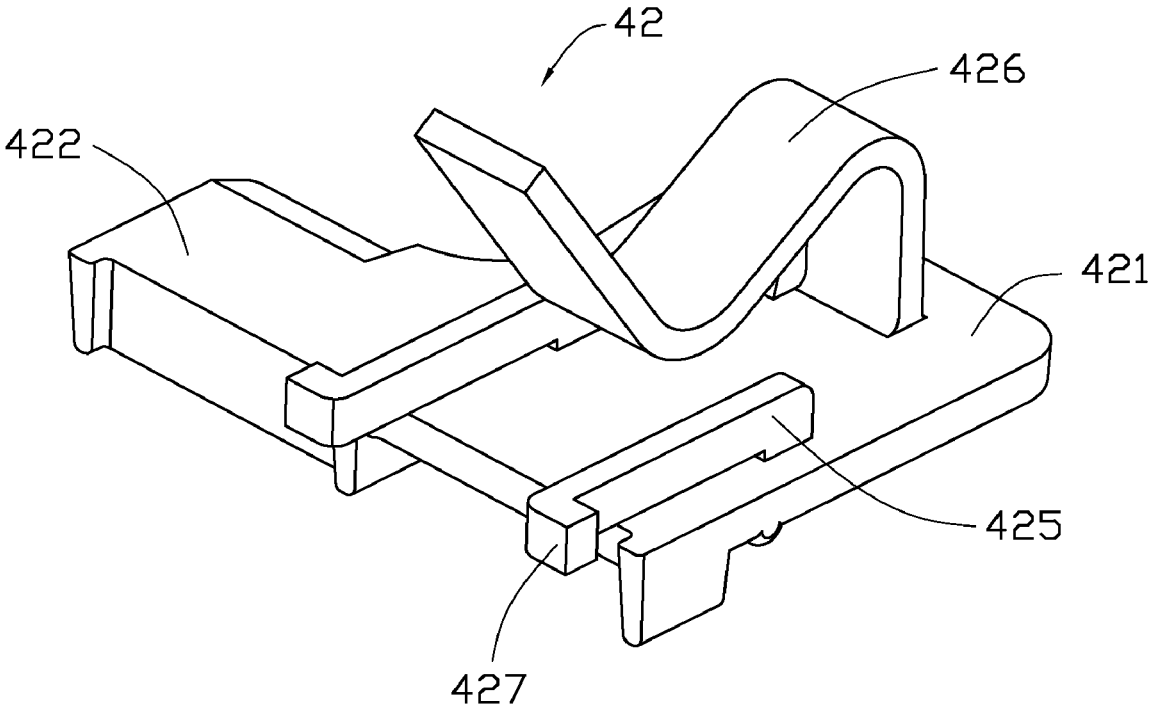
FIG. 4 is an enlarged isometric view of a detaching apparatus in accordance with a second embodiment of the present invention.

Referring to FIG. 4, a detaching apparatus is provided in accordance with a second embodiment of the present invention. The detaching apparatus includes an operating member 42, which is similar to the operating member 32 of the first embodiment. The operating member 42 includes a main body 421, a pressing portion 422 extending from an edge of the main body 421, and a generally N-shaped elastic arm 426 extending from a bottom portion of the main body 421. Two elastic legs 425 integrally extend longitudinally along another bottom portion of the main body 421, and a hook 427 extends outward from a free end of each elastic leg 425 for engaging in the corresponding through hole 22 of the electronic device 20, and pivotably fixing the operating member 42 to the electronic device 20. In this embodiment, the pivot member 36 of the first embodiment is omitted.

It is believed that the present embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. A detaching apparatus for detaching a connector having an elastic release tab from a mating connector socket of an electronic device, the release tab engagable with the connector socket, the detaching apparatus comprising:

a pivot member configured for being pivotably attached to the electronic device; and an operating member connectable with the pivot member, the operating member manipulably rotatable together with the pivot member for pressing the release tab to disengage from the connector socket of the electronic device;

wherein the operating member forms a pressing portion configured for abutting against the release tab of the connector; and wherein a slanted surface is formed on a bottom of the pressing portion.

2. The detaching apparatus as claimed in claim 1, wherein the electronic device defines a pair of through holes therein, the pivot member comprises two elastic legs, and an engaging portion extends outward from a free end of each of the elastic legs for engaging in a corresponding through hole of the electronic device.

3. The detaching apparatus as claimed in claim 2, wherein the operating member comprises a main body, an elastic arm extends from a bottom portion of the main body, and a free end of the elastic arm abuts against the electronic device.

4. The detaching apparatus as claimed in claim 3, wherein a fixing plate extends perpendicularly from the bottom portion of the main body, and a flange is perpendicularly formed on the fixing plate holding one of the elastic legs of the pivot member to the main body.

5. The detaching apparatus as claimed in claim 3, wherein the pivot member further comprises a cross member connecting the elastic legs, a fixing portion extends perpendicularly from the elastic arm adjacent to the main body for attaching the cross member of the pivot member to the main body.

6. The detaching apparatus as claimed in claim 5, wherein the pivot member is generally U-shaped.

7. The detaching apparatus as claimed in claim 5, wherein the elastic arm is generally N-shaped.

8. The detaching apparatus as claimed in claim 1, wherein a plurality of ribs is formed on a top portion of the operating member.

9. A detaching apparatus detaching a connector having an elastic release tab from a connector socket of an electronic device, the release tab engaging with the connector socket for securing the connector to the connector socket, the detaching apparatus comprising:

an operating member pivotably fixed to the electronic device, the operating member comprising a pressing portion configured for abutting against the release tab for disengaging the release tab from the connector socket before detaching the connector from the electronic device, and an elastic arm being deformable and configured for abutting against the electronic device for restoring the operating member.

10. The detaching apparatus as claimed in claim 9, wherein the electronic device defines a pair of through holes therein, the operating member comprises a pair of elastic legs, and a hook extends outward from a free end of each of the elastic legs for engaging in a corresponding through hole of the electronic device.

11. The detaching apparatus as claimed in claim 9, wherein the elastic arm is generally N-shaped, an end of the elastic arm is connected with a bottom portion of the operating member, and the other end of the elastic arm abuts against the electronic device.

12. The detaching apparatus as claimed in claim 9, wherein a slanted surface is formed on a bottom of the pressing portion.

13. The detaching apparatus as claimed in claim 9, wherein a plurality of ribs is formed on a top portion of the operating member.

14. A detaching apparatus configured for detaching a connector having an elastic release tab from a connector socket of an electronic device, the release tab engaging with the connector socket for securing the connector to the connector socket, the detaching apparatus comprising:

a main body pivotably attached to the electronic device at one side of the connector;

a pressing portion extending laterally from the main body to locate above the release tab configured for abutting against the release tab to disengage the release tab from the connector socket before detaching the connector from the electronic device; and an elastic member extending from the main body and having a distal end abutting against the electronic device for restoring the main body and the pressing portion.

15. The detaching apparatus as claimed in claim 14, wherein the electronic device defines a pair of holes, and the main body is pivotably attached to the electronic device via a pivot member which has a pair of pivot ends pivotably received in the holes respectively.

16. The detaching apparatus as claimed in claim 15, wherein the pivot member has a U shape made of a wire.

17. The detaching apparatus as claimed in claim 15, wherein the pivot member is integrally formed at the main body.

18. The detaching apparatus as claimed in claim 14, wherein the elastic member is N-shaped.

* * * * *